United States Patent [19]

Lew

[11] 4,226,167

[45] Oct. 7, 1980

[54] AIR-SPRING RETURN AIR CYLINDER

[76] Inventor: Yon S. Lew, 7890 Oak St., Arvada, Colo. 80005

[21] Appl. No.: 907,030

[22] Filed: May 17, 1978

[51] Int. Cl.[3] ..... F15B 15/22; F01B 7/00

[52] U.S. Cl. ..... 91/399; 91/401; 92/134; 92/152

[58] Field of Search ..... 91/235, 234, 230, 231, 91/390, 399, 417 A, 416, 401; 92/152, 134

[56] References Cited

U.S. PATENT DOCUMENTS

| | | | |
|---|---|---|---|
| 805,633 | 11/1905 | Clement | 91/230 |
| 2,797,664 | 7/1957 | Swanson | 91/234 |
| 3,376,790 | 4/1968 | Matson | 91/235 |

*Primary Examiner*—Paul E. Maslousky

[57] ABSTRACT

The use of the air-spring in automatically retracting (or extending) an air cylinder after it was extended (or retracted) by the air pressure supplied from the compressed air line is disclosed.

4 Claims, 3 Drawing Figures

AIR-SPRING RETURN AIR CYLINDER

In order to incorporate the "fail-safe" feature in the plant operation, it is often required to use an actuator for operating valves, switches, etc., which automatically shuts off (or opens) when the plant utility system fails. The mechanical coil spring employed in the "spring-return air-open" type of actuators generates a returning force which is often too small to activate many control systems.

The primary object of the present invention is to provide an air cylinder, which automatically returns by the air-spring force provided by the compressed air supplied from the compressed air line and stored within the air cylinder.

An another object of the present invention is to provide an automatically returning air cylinder, which generates a large amount of the returning force.

Further object of the present invention is to provide a powerful air cylinder, which is economic and reliable.

These and other object of the present invention will become clear as the description and specification of the present invention proceeds. The present invention may be described with great clarity and specificity by referring to the figures showing the embodiment of the principles of the present invention.

Figure 1:
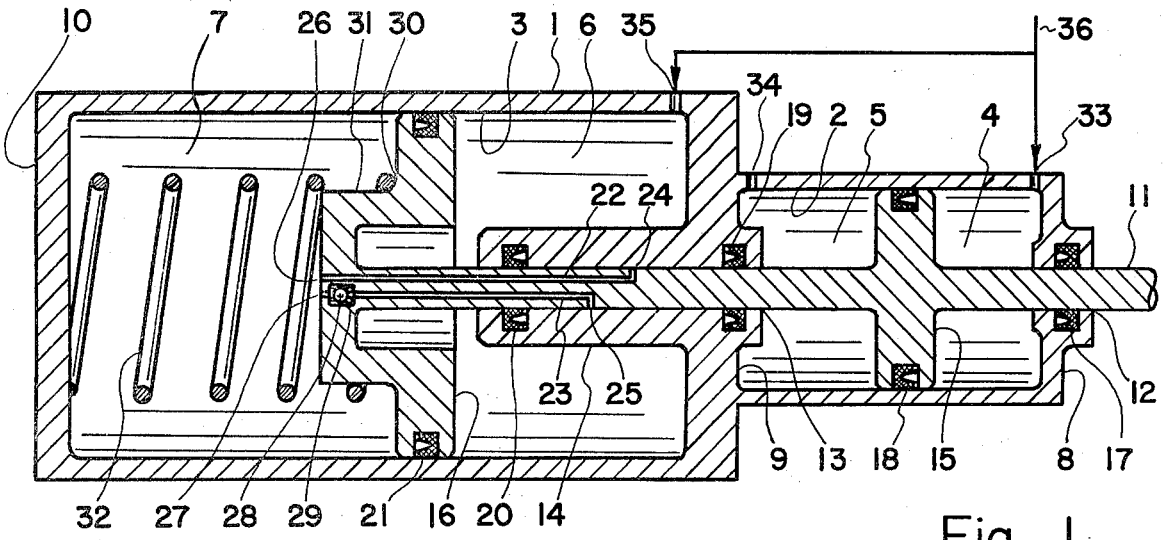

In FIG. 1, there is shown a cross section of the "air-spring return air cylinder" taken along a plane passing through the center line of said air cylinder, which is constructed in accordance with the principles of the present invention. The cylinder 1 has a pair of cylindrical cavities having bores 2 and 3, respectively. The second cavity with bore 2 is divided into third compartment 4 and fourth compartment 5 by the piston 15 tightly and slidably engaging the bore 2. The first cavity having bore 3 is divided into first compartment 6 and second compartment 7 by the piston 16 tightly and slidably engaging the bore 3. The pistons 15 and 16 are rigidly affixed onto the common connecting rod 11 slidably engaging a hole 12 disposed on one end 8 of cylinder 1. The portion of the connecting rod 11 intermediate the pistons 15 and 16 engages a hole 13 bored through a neck 14 disposed on the wall 9 separating said pair of cavities. The other end 10 of the cylinder 1 is closed. The seals 18 and 21 disposed around the pistons 15 and 16, respectively, and the seals 17, 19 and 20 disposed on the end 8 and the neck 14, respectively, allow the sliding movement of the piston-connecting rod assembly relative to the cylinder, while preventing the air in each compartment from leaking across said seals. The compressed air line 36 is connected to third compartment 4 and first compartment 6 through the ports 33 and 35, respectively. The fourth compartment 5 is vented to the atmosphere by the vent port 34. A pair of air holes 22 and 23 are bored in the portion of the connecting rod 11 intermediate two pistons 15 and 16. One end 26 of the air hole 22 is open to second compartment 7 and the other end 24 is on the side of the connecting rod 11. The end 24 of the air hole 22 crosses the seal 19 only when the piston-connecting rod assembly is fully extended. Otherwise, the end 24 of the air hole 22 is located between two seals 19 and 20. The air hole 23 which is open to the second compartment 7 through one end 27 has a built-in check valve comprising a ball 28 and an O-ring 29, which combination allows the air to flow in the direction from the ends 25 to 27 only. The end 25 of the air hole 23 disposed on the side of the connecting rod 11 crosses the seal 20 only when the piston-connecting rod assembly is fully or nearly fully retracted. Otherwise, the end 25 is located between two seals 19 and 20. The shoulder 31 locates the coil spring 32 at the center of the cavity in the cylinder 1. The ends of the coil spring 32 are seated on seat 30 built on the piston 16 and the end 10 of the cylinder 1, respectively.

With the specified construction of the "air-spring return air cylinder" mentioned above, said air cylinder shown in FIG. 1 operates in the following principle: When the compressed air is directed in to third compartment 4 and first compartment 6 the pistons 15 and 16 are pushed toward to the end 10 and, thus, retracts the piston-connecting rod assembly. When the piston-connecting rod assembly becomes fully retracted, the end 25 of the air hole 23 crosses the seal 20 and, consequently, the compressed air enters into the compartment 7 from first compartment 6 through the air hole 23. Therefore, as long as the compressed air is directed to the ports 33 and 35, the air cylinder retracts and remains at the fully retracted position, in which state third compartment 4, first compartment 6 and second compartment 7 are pressurized. It should be mentioned that, as the force on two sides of the piston 16 substantially cancels one another, the fully retracted position of the air cylinder is actively maintained by the force acting on the piston 15. When the compressed air in the line 36 is vented or accidentally fails, the compressed air in third compartment 4 and first compartment 6 becomes vented immediately through the line 36. However, the compressed air in second compartment 7 remains trapped there because of the check valve comprising the ball 28 and 0-ring 29, which trapped air pushes the piston 16 and, thus, extends the piston-connecting rod assembly. As the piston-connecting rod assembly becomes fully extended, the end 24 of the air hole 22 crosses the seal 19, in which position the compressed air in second compartment 7 becomes vented into the fourth compartment 5 and, then, into the atmosphere through the vent port 34. Consequently, there is no force forcing the piston-connecting rod assembly to remain at the fully extended position, which condition facilitates the retraction of the piston-connecting rod assembly by pressurizing third compartment 4 and first compartment 6 again. The function of the coil spring 32 is to provide a force that actively maintains the fully extended position even after the compressed air in the second compartment 7 becomes completely vented. In cases where the valve operated by the air cylinder jams partially at the fully closed or open positions, the use of the coil spring 32 is not required.

In order to further the understanding of the operation of the "Air-Spring Return Air Cylinder" shown in FIG. 1, the following explanation is in order: The illustration shown in FIG. 1 shows the intermediate position of the piston-connecting rod assembly with respect to the cylinder. In order to retract the piston rod 11, compressed air is directed into first compartment 6 and third compartment 4 through the compressed air line 36. The air pressure in first compartment 6 creates a force on piston 16 and the air pressure in third compartment 4 creates a force on piston 15, both of which forces make the piston rod 11 to retract. The air port 25 is placed in such a way that said air port 25 crosses seal 20 when the piston rod 11 is fully or nearly fully retracted. Once air port 25 moves across the seal 20, the air hole 23 short-circuit the first compartment 6 and second compartment 7. As a consequence, the compressed air flows from first compartment 6 to second compartment 7 through air hole 23 until the pressure in second compartment 7 becomes the same as that of first compartment 6, which pressure is equal to the pressure of the air supply through line 36. At said state of the air cylinder, the force retracting the connecting rod 11 is the forces on the piston 16 and 15 created by the air pressure in first compartment 6 and third compartment 4, respectively, while the force trying to extend the piston rod 11 is the force on piston 16 created by the air pressure in second compartment 7 plus the spring force from the compression spring 32. Therefore, it is necessary to employ a sufficient cavity diameter for second cavity with bore 2 so that the retracting force overwhelms the extending force whenever first compartment 6 and third compartment 4 are pressurized. As a matter of fact, it should be understood that the spring 32 and air hole 22 are not needed when the bore 2 has a sufficiently large diameter. For the sake of simplicity, let us consider a particular combination wherein the bore diameters are the same for bores 2 and 3. In said case, the retracting force exerted on piston 15 by the air pressure in third compartment is at worst equal to the extending force exerted on piston 16 by the air pressure in second compartment (equal when the connecting rod 11 is fully retracted, and greater when the connecting rod 11 becomes extended, as the trapped air in second compartment 7 becomes partially expanded). Therefore, the retracting force exerted on piston 16 by the air pressure in first compartment 6 is fully utilized to retract the connecting rod 11. When first compartment 6 and third compartment 4 are vented, the trapped air in second compartment retaining pressure equal to the compressed air line pressure at fully retracted state pushes out piston 16 and thus extends the connecting rod 11. (remember that there is no spring 32 and vent air hole 22 in this combination under discussion). At the fully extended state, the trapped air in second compartment 7 becomes expanded and provides residual force that maintains the air cylinder at fully extended state.

Figure 2:
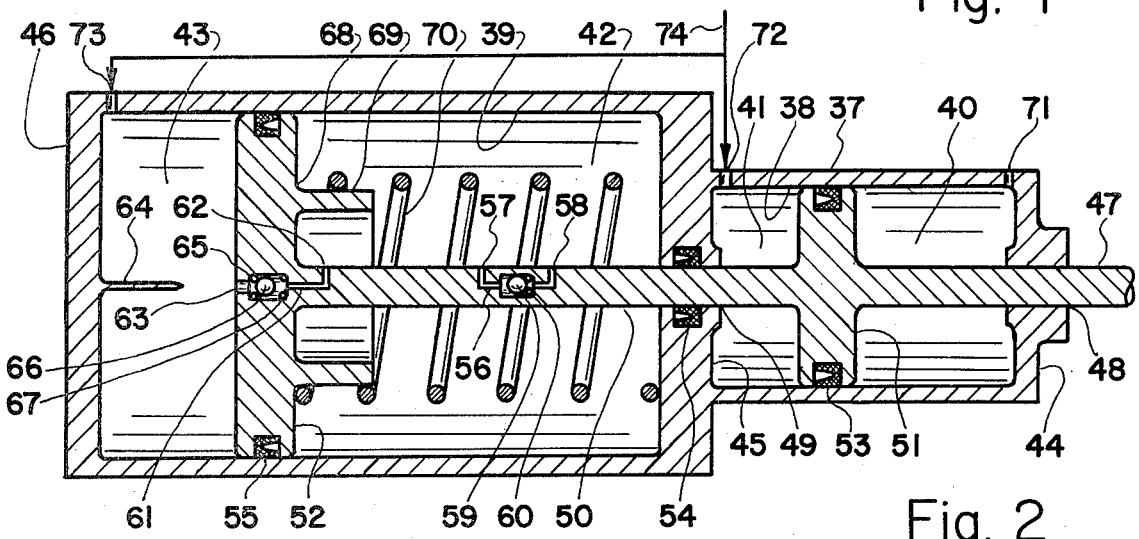

In FIG. 2, there is shown another embodiment of the "air-spring return air cylinder", wherein the roles played by the air holes 22 and 23 in FIG. 1 are now played by the air holes 61 and 56, respectively. When the compressed air in line 74 is directed into the compartments 41 and 43 through ports 72 and 73, respectively, the compressed air entering the compartments 41 and 43 pushes the pistons 51 and 52 toward to the end 44 of the cylinder 37 and, thus, extends the piston-connecting rod assembly. When the piston-connecting rod assembly becomes fully extended, the end 58 of the air hole 56 crosses the seal 54, while the other end 57 stays on the compartment 42 side. As a consequence, the compressed air in the compartment 41 flows into through the air hole 56 and pressurizes the compartment 42. When the compressed air line 74 is vented or accidentally fails while the air cylinder is at the fully extended state, the compressed air in the compartments 41 and 43 becomes vented immediately through the ports 72 and 73. However, the compressed air introduced into the compartment 42 from the compartment 41 through the air hole 56 remains trapped in the compartment 42 as the check valve comprising the ball 59 and the O-ring 60 prevents the compressed air from flowing back to the compartment 41. Therefore, the compressed air trapped in the compartment 42 pushes the piston 52 toward to the end 46 of the cylinder 37 and, thus, retracts the piston-connecting rod assembly. When the piston-connecting rod assembly becomes fully retracted, the pin 64 on the end 46 engages the hole 63 and pushes the ball 66 away from the O-ring 65, which action allows the compressed air trapped in the compartment 42 to escape by entering the end 62 of the air hole 61 and, then, becomes vented to port 73 via the compartment 43. The combination of the ball 66 and O-ring 67 is to prevent the compressed air in the compartment 43 from entering into the compartment 42 during the extending process of the air cylinder. The role of the coil spring 70 is to maintain the fully retracted position of the air cylinder even after the compartment 42 becomes completely vented.

Figure 3:
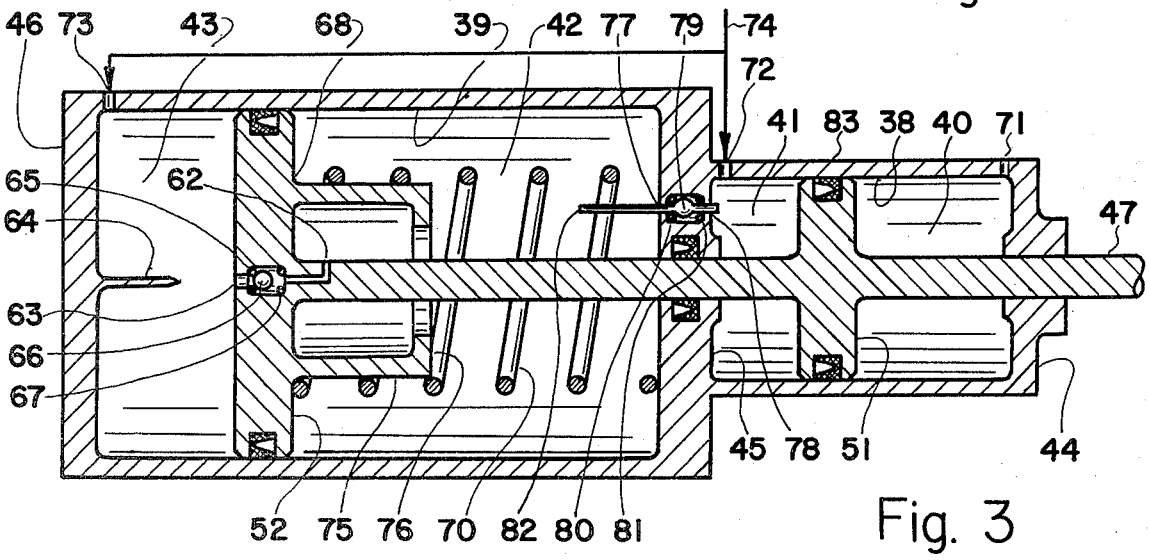

In FIG. 3, there is shown a further embodiment of the principles of the present invention in constructing an "air-spring return air cylinder", wherein another air cylinder identical to that shown in FIG. 2 other than the mechanism for introducing the compressed air into the compartment 42 from the compartment 41, is illustrated. In the air cylinder shown in FIG. 3, the check valve comprising a ball 79 with a rod 82 and a pair of O-rings 80 and 81 plays the same role as the check valve comprising the ball 59 and O-ring 60 in FIG. 2. At the fully extended position, the end face 76 built on the shoulder 75 on the piston 52 pushes the rod 82, which, in turn, lifts the ball 79 from the O-ring 80, which action allows the compressed air to flow into the compartment 42 from the compressed air line 74 via the compartment 41. The O-ring 81 is to prevent the compressed air from flowing back to the compartment 41, when the compressed air line 74 is vented or accidentally fails. With this arrangement, the air cylinder illustrated in FIG. 3 operates in the same principle as that shown in FIG. 2.

While the principles of the invention have now been made clear in an illustrative embodiment, there will be immediately obvious to those skilled in the art many modifications of structures, arrangement, proportions, the elements, materials and components used in the practice of the invention which are particularly adapted for specific environments and operating requirements without departing from those principles.

I claim:

1. An air cylinder comprising:

(a) a cylinder having a first cylindrical cavity engaged by a first piston and a second cylindrical cavity engaged by a second piston, said first and second pistons rigidly connected to a connecting rod engaging a hole disposed on one end of said cylinder, whereby, said connecting rod extends from and retracts into said cylinder depending on the force exerted on said first and second pistons by compressed air introduced into said cylinder; (b) a first means for introducing the compressed air into and venting from first and third compartments, said first compartment being one side half of said first cylindrical cavity divided into compartments by said first piston, and said third compartment being one side half of said cylindrical cavity divided into two compartments by said second piston; whereby the introduction of the compressed air into said first and third compartments pushes said connecting rod to one extreme position, said one extreme position being either the fully retracted position or the fully extended position; by a second piston, said first and second piston rigidly connected to a connecting rod engaging a hole disposed on one end of said cylinder, whereby, said connecting rod extends from and retracts into said cylinder depending on the force exerted on said first and second pistons by the compressed air introduced into said cylinder;

(b) a first means for introducing the compressed air into and venting from a first and third compartments, said first compartment being one side half of said first cylindrical cavity divided into two compartments by said first piston, and said third compartment being one side half of said cylindrical cavity divided into two compartments by said second piston; whereby, the introduction of the compressed air into said first and third compartments pushes said connecting rod to one extreme position, said one extreme position being either the fully retracted position or the fully extended position;

(c) a second means for introducing the compressed air into a second compartment, said second compartment being the other side half of said first cylindrical cavity divided into two compartments by said first piston, said first means including means for preventing the compressed air entered into said second compartment from flowing out of said second compartment;

(d) a third means for venting the compressed air entered into said second compartment, said third means allowing the compressed air in said second compartment to vent only when said connecting rod is located at the other extreme position, said the other extreme position being the opposite to said one extreme position; whereby, the compressed air introduced into said first and third compartments pushes said connecting rod to said one extreme position, said one extreme position being maintained by the force exerted on said second piston by the compressed air in said third compartment, while the force exerted on two sides of said first piston by the compressed air in said first and second compartments canceling one another; upon venting said first and third compartments, the compressed air trapped in said second compartment by means of said second means pushes said connecting rod to said other extreme position, said compressed air trapped in said second compartment being vented by means of said third means only after said connecting rod is moved to said the other extreme position; whereby, said connecting rod can be facily moved back to said one extreme position again by introducing the compressed air back to said first and third compartments.

2. The combination as set forth in claim 1 wherein said second means for introducing the compressed air into said second compartment further includes a means for allowing the compressed air into said second compartment only when said connecting rod is positioned at said one extreme position.

3. The combination as set forth in claim 2 wherein a coil spring is disposed within said cylinder to exert a force actively maintaining said air cylinder at said the other extreme position even after the compressed air in said second compartment is completly vented.

4. The combination as set forth in claim 2 wherein a third means for venting the compressed air entered into said second compartment is included, said third means allowing the compressed air in said second compartment to vent only when said connecting rod is located at the other extreme position, said the other extreme position being the opposite to said one extreme position; whereby, said compressed air trapped in said second compartment is being vented by means of said third means only after said connecting rod is moved to said the other extreme position; whereby, said connecting rod can be moved back with facility to said one extreme position again by introducing the compressed air back to said first and third compartments.

* * * * *

UNITED STATES PATENT AND TRADEMARK OFFICE

CERTIFICATE OF CORRECTION

PATENT NO. : 4,226,167

DATED : October 7, 1980

INVENTOR(S) : Yon Sugn Lew

It is certified that error appears in the above—identified patent and that said Letters Patent is hereby corrected as shown below:

Column 5, line 20, "first" (second occurrence) should read -- second --.

Column 5, cancel lines 24-29;

Column 5, line 30, cancel "one extreme position";

Column 5, line 38, insert -- substantially -- after "compartments";

Column 6, lines 4 to 11 cancel "said compressed.... third compartments".

Signed and Sealed this

*Twenty-sixth* Day of *May 1981*

[SEAL]

*Attest:*

RENE D. TEGTMEYER

*Attesting Officer*

*Acting Commissioner of Patents and Trademarks*

UNITED STATES PATENT AND TRADEMARK OFFICE

CERTIFICATE OF CORRECTION

PATENT NO. : 4,226,167

DATED : October 7, 1980

INVENTOR(S) : Yon Sung Lew

It is certified that error appears in the above—identified patent and that said Letters Patent is hereby corrected as shown below:

Column 4, line 52, delete "(b) a"

Column 4, delete lines 53 to 68

Column 5, delete lines 1 to 3

Signed and Sealed this

*Thirty-first* Day of *August 1982*

[SEAL]

*Attest:*

GERALD J. MOSSINGHOFF

*Attesting Officer*

*Commissioner of Patents and Trademarks*